US011388988B2

(12) United States Patent
Egelund et al.

(10) Patent No.: US 11,388,988 B2
(45) Date of Patent: Jul. 19, 2022

(54) LIFTING TABLE AND A METHOD OF OPERATING AND CLEANING A LIFTING TABLE

(71) Applicant: TRANSLYFT A/S, Dybvad (DK)

(72) Inventors: Jens Egelund, Aalborg (DK); Martin Andersen, Sæby (DK); Rolf Joachim Frank, Gandrup (DK)

(73) Assignee: TRANSLYFT A/S, Dybvad (DK)

( * ) Notice: Subject to any disclaimer, the term of this patent is extended or adjusted under 35 U.S.C. 154(b) by 0 days.

(21) Appl. No.: 17/283,650

(22) PCT Filed: Oct. 9, 2019

(86) PCT No.: PCT/EP2019/077352
§ 371 (c)(1),
(2) Date: Apr. 8, 2021

(87) PCT Pub. No.: WO2020/074580
PCT Pub. Date: Apr. 16, 2020

(65) Prior Publication Data

US 2021/0386194 A1 Dec. 16, 2021

(30) Foreign Application Priority Data

Oct. 9, 2018 (EP) ..... 18199365

(51) Int. Cl.
*A47B 9/10* (2006.01)
*A47B 9/16* (2006.01)

(52) U.S. Cl.
CPC . *A47B 9/10* (2013.01); *A47B 9/16* (2013.01)

(58) Field of Classification Search
CPC ..... A47B 9/10; A47B 9/16
See application file for complete search history.

(56) References Cited

U.S. PATENT DOCUMENTS 3,920,101 A * 11/1975 Richards ..... B66B 13/245 108/42
4,091,906 A * 5/1978 Clarke ..... B66F 17/00 187/279

(Continued)

FOREIGN PATENT DOCUMENTS

DE 17 56 318 A1 4/1970
DE 76 12 703 U1 10/1976

OTHER PUBLICATIONS

European Search Report dated Feb. 11, 2019 from corresponding European Patent Application 18199365.0 (two pages).

(Continued)

*Primary Examiner* — Daniel J Rohrhoff
(74) *Attorney, Agent, or Firm* — Crowell & Moring LLP; John C. Freeman, Esq.

(57) ABSTRACT

A lifting table including a platform having a polygonal contour and including an upper and a lower face, a lifting mechanism and a base. The lifting mechanism connected to the table top and including an actuator for raising and lowering the table top. The base configured for supporting the lifting mechanism. Two side members positioned along two adjoining sides of the table top and a switch element positioned below the upper face, wherein the side members are connected to the table top below the upper face allowing the side members to be moved between a first position, wherein the frame members are disengaged from the switch element and a second position where the side members activate the switch element, hereby preventing displacement of the table top relative to the base. Ends of the side members are arranged with a distance in between each other.

20 Claims, 7 Drawing Sheets

(56) References Cited

U.S. PATENT DOCUMENTS

| | | | | |
|---|---|---|---|---|
| 4,556,129 | A * | 12/1985 | Martin | B60P 1/4478 187/279 |
| 5,379,655 | A * | 1/1995 | Yeakle | B66F 7/065 187/269 |
| 7,350,627 | B2 * | 4/2008 | Ketonen | B66B 13/285 187/400 |
| 10,092,089 | B1 * | 10/2018 | Yuan | A47B 3/002 |
| 11,047,520 | B1 * | 6/2021 | Schwind | F16M 11/046 |
| 2020/0375351 | A1 * | 12/2020 | Xiang | A47B 3/02 |

OTHER PUBLICATIONS

International Search Report dated Dec. 12, 2019 from PCT Priority Application PCT/EP2019/077352 (two pages).

International Preliminary Report on Patentability (dated Apr. 8, 2021) and appended Written Opinion of the International Searching Authority dated Dec. 12, 2019 from PCT Priority Application PCT/EP2019/077352 (seven pages total).

* cited by examiner

LIFTING TABLE AND A METHOD OF OPERATING AND CLEANING A LIFTING TABLE

This application is a National Stage application of International Application No. PCT/EP2019/077352, filed Oct. 9, 2019, the entire contents of which are incorporated herein by reference.

This application claims priority under 35 U.S.C. § 119(a) to European Patent Application No. 18199365.0, filed on Oct. 9, 2018, the entire contents of which are incorporated herein by reference.

BACKGROUND OF THE INVENTION

Field of the Invention

The present invention relates to a lifting table comprising a table top having a polygonal contour and including an upper and a lower face, a lifting mechanism and a base where the lifting mechanism is connected to the table top and includes an actuator for raising and lowering the table top. The base is configured for supporting the lifting mechanism. Two side members are positioned along the sides of said table top and at least one switch element being positioned below said upper face. The side members are connected to the table top below said upper face allowing the side member to be moved between a first position, wherein the side members are disengaged from the switch element and a second position where the side members activate the switch element, hereby preventing displacement of the table top relative to the base.

Description of the Related Art

At present is has been known to use lifting tables having a lifting mechanism for different lifting tasks within the food industries or the pharmaceutical manufacturing industries.

However, during the manufacturing process, there is a need for cleaning and/or disinfecting the equipment. By cleaning the equipment, it is possible to avoid contamination during subsequent production of another product or the same product. The product can be bulk food, goods, and pharmaceutical products to be consumed or used by human. Typically, the manufacturing equipment has to be cleaned on a daily basis, preferably at the end of the work day. A cleaning process can be achieved by using a low-pressure water-jetting unit for spooling off the leftovers in the form of raw materials followed by a chemical cleaning process using a cleaning foam, which makes it easier to clean hard-to-reach areas such as corners.

Even after the equipment has be cleaned with water possibly in combination with a standard cleaning product, there might be a need to disinfect the equipment in a subsequent step e.g. applying the chemical product onto the lifting table.

One problem associated with the tasks of cleaning and disinfecting a lifting table is that at least the cleaning process but also the disinfecting process is quite time consuming as the table top includes a lot of corners and hard-to reach areas and the cleaning fluid or the cleaning foam has a limited capability to penetrate into those corners (blind area).

The objective problem of the present invention is to provide an improvement in relation to a lifting table, where hard-to-reach area(s) have been removed.

A further object is to improve cleaning or disinfecting of a lifting table.

It is an object of the present invention to provide a lifting table, where a least two side members are arranged along two adjoining sides of the table top, wherein the ends of said two side members are arranged with a distance in between each other, such as 1-8 mm.

SUMMARY OF THE INVENTION

The anti-squeezing mechanism will include at least two side members being arranged along the sides of the lifting table and one switch element being connected to a lower face of the table top. The elongated elements are movable individually relative to the table top.

The lifting table according to the present invention has the advantage, that by arranging two adjoining side members along two adjoining sides of the table top, it is possible in combination with at least one switch element to achieve an anti-squeezing mechanism, which does not include a blind area where the material or dust can be accumulated. By arranging two side members with a distance in between each other, it is furthermore possible for the cleaning foam to penetrate into the gap created by two adjoining side members.

The anti-squeezing mechanism will consist of at least two side members being arranged along the sides of the lifting table and one switch element being connected to a lower face of the table top. The elongated elements are movable individually relative to the table top.

The lifting table can be used together with other manufacturing equipment as one or more lifting tables can be integrated into a production line, such as a process line or pallet transport line, where a lifting mechanism can be used for elevating a pallet to a higher level, such as from a first level to a second level.

In the context of this application, the term "elongated element" is used to describe an element being part of the lifting mechanism of the lifting table, where each of the elongated elements includes a front end and a back end can be fixated relative to the table top or the base. The elongated element could also be referred to as a leg.

In an embodiment according to a first aspect of the present invention, the number of side members corresponds to the number of sides of the table top, preferably a table top having a rectangular geometry with four side members positioned along the side of the table top. By using a number of side members corresponding to the number of sides of the table top, it is possible to cover all of the sides of said lifting table, hereby providing an anti-squeezing mechanism that ensures that an operator is not able to get squeezed during a lowering operation of said lifting table. By using four elongated elements connected to the table top, it is possible to cover all sides of the table top.

In an embodiment according to a first aspect of the present invention, the side members are connected to each other by a number of brackets. The bracket is used for fixating the side members relative each other, hereby achieving an improvement when the lifting table has to be assembled. The bracket provides a further advantage as it is possible to maintain the distance, also referred to as the gap, between two adjoining elongated elements of the anti-squeezing mechanism.

In an embodiment according to a first aspect of the present invention, the table top includes a number of side walls arranged along the sides of the table top, wherein the side walls extend perpendicularly from the upper face of the table top, wherein at least one side wall includes a number of slots arranged at a first distance from the side end(s) of the side wall. The table top can include a number of side walls arranged along the sides of the table top to avoid any blunt and/or shape edges. To enhance the possibility for achieving a proper cleaning of the anti-squeezing mechanism, the side wall includes a number of apertures or slots, which will enable a cleaning foam to penetrate into the space between a side wall of the table top and a elongated element of the anti-squeezing mechanism.

In an embodiment according to a first aspect of the present invention, wherein each side member is provided with an aperture for allowing the side members to be moved relative to the table top. By arranging one or more apertures in the side members, it is possible to displace the side members relative to the side walls of the table top for allowing the side members to be moved between a first position, wherein the side members are disengaged from the switch element and a second position where the side members activate the switch element, hereby preventing displacement of the table top relative to the base.

In an embodiment according to a first aspect of the present invention, the side members are provided for covering the slots of the side walls and/or the side members are provided with a side member end extending towards the center of the table top, preferably at an angle of 30-70 degree. Preferably, the side members are arranged perpendicularly to the table top and therefor the ends of the side members should not include any sharp edges and/or ends. The above can be achieved, if the ends of the elongated elements extend towards the center of the table top, when the elongated elements are mounted relative to the table top.

In an embodiment according to a first aspect of the present invention, the lifting table further includes a leg element being pivotably connected to the table top at a first leg element end, preferably to a lower face, wherein a fixation element is provided on the base for engaging a connecting element positioned on the leg element, preferably on the opposite end of the first leg element end. The leg element can be retracted from an inactive position to an active position allowing the operator of the lifting table to position the table top into an inclined angle, when the lifting table has to be cleaned or disinfected.

In an embodiment according to a first aspect of the present invention, lifting table further includes an arm connected to the base (40) at a first end, wherein a fixation element is arranged to the lower face of the table top for engaging a connecting element being positioned on the arm, wherein the arm is pivotably connected to the base.

In an embodiment according to a first aspect of the present invention, lifting table further includes a separate arm being configured for engaging the base and the lifting mechanism.

In an embodiment according to a first aspect of the present invention, the lifting mechanism is connected to the table top through a number of fixating mounting brackets for allowing the elongated elements of the lifting mechanism to rotate relative to the table top at a first end, wherein each elongated element furthermore includes a roller positioned at the opposite end of the first end. By using a lifting mechanism including a number of rollers, it is possible to obtain a guide movement of the table top as the lifting mechanism is only partially fixated to the base and the table top via a number of fixating mounting brackets.

In an embodiment according to a first aspect of the present invention, the lifting mechanism includes a number of elongated elements being connected to the table top and said elongated elements are arranged to form a scissor mechanism, wherein the structural part such as the elongated elements are made from a galvanized metal. By using stainless metal, such as AIS3 304 or higher alloy for the structural parts of the lifting table, it is possible to obtain a lifting table, which is suitable for operating in a food and/or pharmaceutical production facility. Stainless steel has an increased corrosion resistance, particularly against chlorides and other industrial solvents. Due to its non-reactive qualities, stainless steel is also used in the manufacture of medical surgical instruments. Alternative 300-series grades can contain up to 7 percent molybdenum. They provide even better chloride resistance, but such heavy-duty resistance is only necessary in industrial or high concentration exposure conditions. It is also possible to use a galvanized metal or stainless steel, in particular hot galvanized steel and/or plastic or plastic-coated steel, for the structural parts of the lifting table.

In an embodiment according to a first aspect of the present invention, the lifting table further includes a controller being connected to the actuator and the switch element, wherein said switch element is configured for deactivating the actuator. The controller can generally be configured for allow the lifting mechanism to be displaced and the controller is furthermore configured for receiving input from one or more switch elements. The switch element could be a sensor e.g. switch, pressure sensor, light sensor or wire sensor. The switch element is preferably positioned on the lower face of the table top, to disable operation of the lifting mechanism, such as lowering of the table top, by deactivating the actuator connected to the lifting mechanism.

In an embodiment according to a first aspect of the present invention, the actuator is a hydraulic actuator connected to a power source for supplying hydraulic fluid to the actuator and/or motor driven spindle connected to a power source for supplying hydraulic fluid to the actuator. Hydraulic actuators or motor driven spindles have the capability to be used for different lifting tasks, such as lifting a number of bucks or barrels containing the product used in a manufacturing line. Pneumatic belt driven actuator or other drives can be used.

In another embodiment of the invention, the table top can have a variety of shapes, configurations and sizes. A table top generally has a square or rectangular shape; however, it can be appreciated that the table top can have other configurations (e.g., circular, oval, polygonal, etc.). Generally, the table top has a surface area and shape that can accommodate the dimensions of commonly sized pallets; however, this is not required. In one non-limiting configuration, the upper face of the table top has a generally rectangular or square shape and a width of about 0.5-4 m and a length of about 0.5-10 m.

In the context of this application, the term "table top" has be used to define a top element of a lifting table. It is therefore within the scope of the present invention that the element could have been referred to as a platform, top support surface or upper surface element, etc.

BRIEF DESCRIPTION OF THE DRAWINGS

References are made to the accompanying drawings that form a part of this disclosure, and which illustrates the embodiments in which the lifting table and methods described in the specification can be practiced.

DETAILED DESCRIPTION

The invention will now be explained in more detail by means of exemplary embodiments with reference to the drawings.

Figure 1:
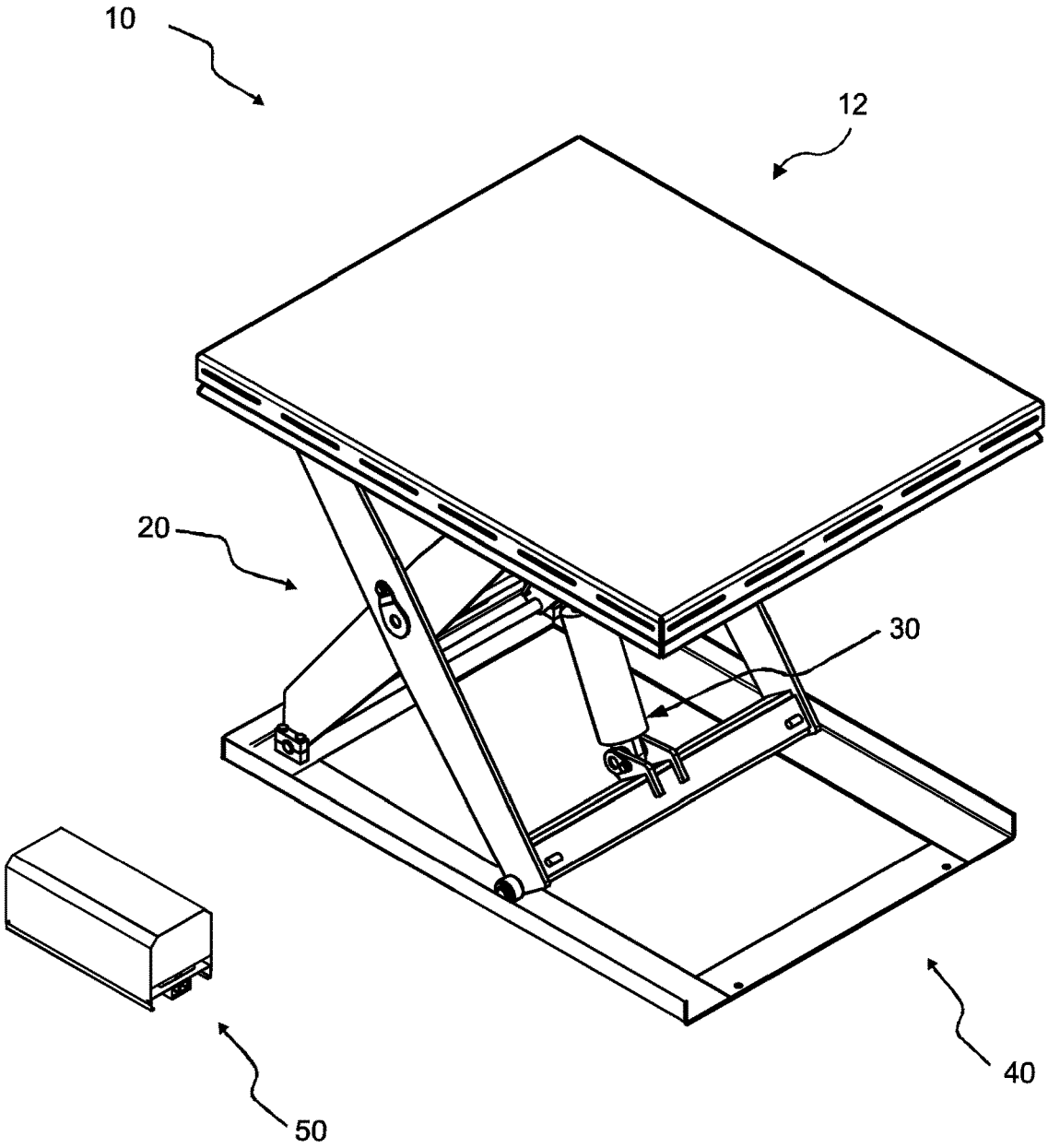
FIG. 1 illustrates a lifting table with which the embodiments described in this specification can be practiced, according to some embodiments.

Attention is first directed to FIG. 1, of the drawings. In FIG. 1, the lifting table 10 includes a table top 12 with a polygonal contour and the lifting table includes an upper 11 and a lower face 13, a lifting mechanism 20 and a base 40. The lifting mechanism 20 is connected to the table top 12 and an actuator 30 is used for raising and lowering the table top 12. The base 40 is configured for supporting and possibly guiding the lifting mechanism 20. The base 40 shown in the FIGS. includes four base elements; it is however possible to have a base 40 having two rails being interconnected for allowing the lifting mechanism 20 to be guided on said rails and the base 40 can furthermore include a number of levelling feet to avoid the base from being in direct contact with the floor in the production facility. The table top could include a turn table or roller conveyer (not shown) for positioning of items arranged on top of the table top 12. In the situation that the lifting table 10 is used for lifting personal, the lifting table will also include one or more hand rails (not shown).

Figure 5A:
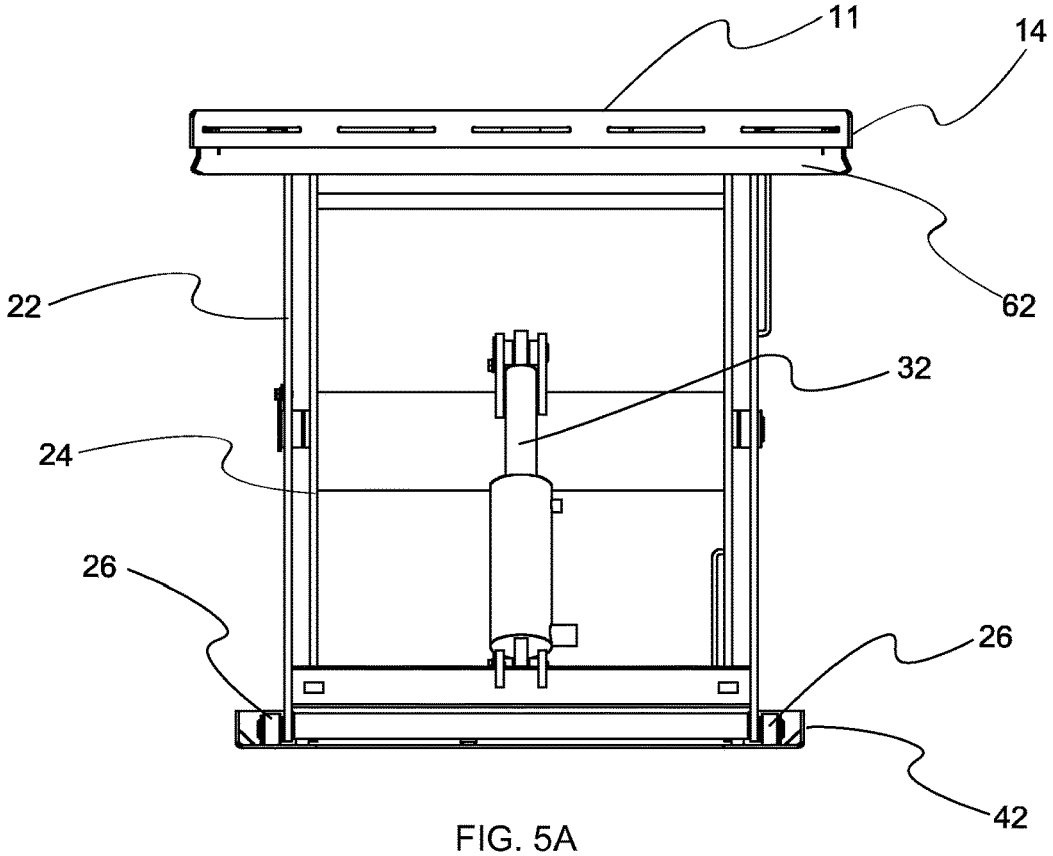
FIG. 5A shows a front view of the table top shown in FIG. 1.
Figure 5B:
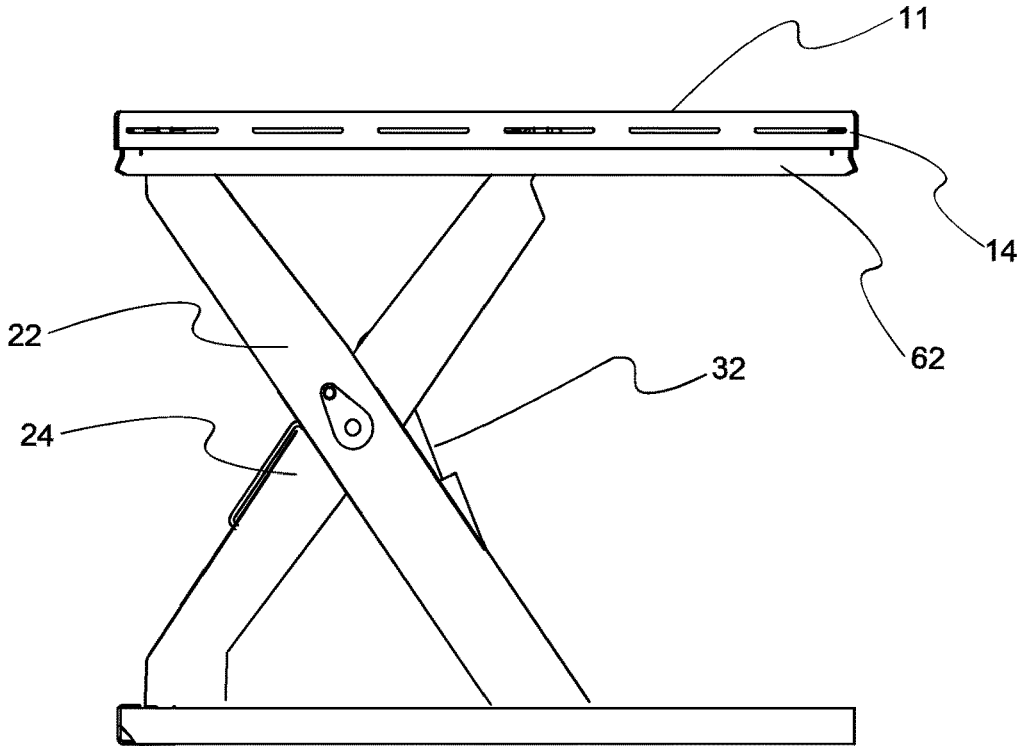
FIG. 5B shows a side view of the table top shown in FIG. 1.

FIG. 5A shows a front view of the table top shown in FIG. 1 whereas FIG. 5B shows a side view of the table top shown in FIG. 1. In both figures, the lifting table is extended to a maximum position for the lifting table as the actuator is extended to an outer position.

In the embodiment shown in FIGS. 1, 2A, 5A-6D, the number of side members 62, 63, 64, 65 corresponds to the number of sides of the table top 12. The table top 12 has a rectangular geometry with four side members 62, 63, 64, 65 being positioned along the side of the table top 12.

The lifting mechanism 20 includes four elongated elements 22,24, which are connected to the table top 12 and said elongated elements 22,24 are arranged to form a scissor mechanism. The elongated elements are made from a galvanized metal.

A controller 50 can be used by an operator to control the lowering and lifting operation of the lifting table 10 and the controller may be connected to the actuator 30 and the switch element(s) 80 can be positioned under the table top 12, preferably connected to the side wall of the table top, directly to the table top or directly to the side member 62 table top. When one or more of side members 62,63,64,65 are moved, the switch element is engaged and a signal is send to the controller. The actuator can be a hydraulic actuator with a piston rod 32 being connected to the lifting mechanism. It is possible to have just one switch element or to have several switch elements positioned on the lower surface of the table top. Independently of the number of switch element used, each switch element is configured to send a signal to the controller in order to deactivating the actuator 30 and hereby prevent further movement of the lifting mechanism.

The lifting table 10 includes an actuator 30 such as a hydraulic actuator connected to a power source for supplying hydraulic fluid to the actuator. Instead, another possible option could be a motor driven spindle, a belt driven actuator or a pneumatic actuator connected to a power source for supplying power to the actuator 30.

Figure 2A:
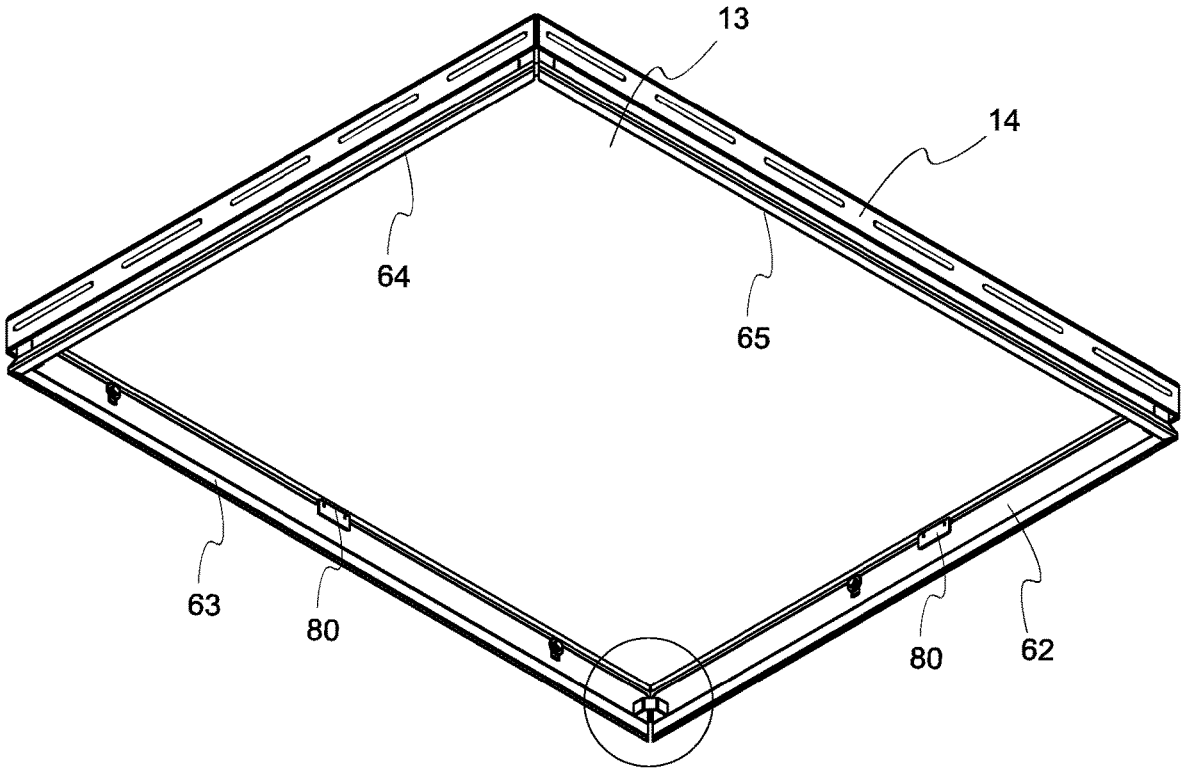
FIG. 2A show a table top according to one preferred embodiment.

Referring now to FIG. 2A, four side members 62, 63, 64, 65 are positioned along the sides of the table top 12 and a corresponding number of switch elements 80 are positioned below the lower face 13. The side members 62, 63, 64, 65 are connected to the table top 12 below the lower face 13 allowing the side members 62, 63, 64, 65 to be moved between a first position (shown in FIGS. 2B, 4A-4C), where the side members 62, 63, 64, 65 are disengaged from the switch element 80 and a second position (not shown) where the side members 62, 63, 64, 65 activate the switch element 80, hereby preventing displacement of the table top 12 relative to the base 40.

Figure 2B:
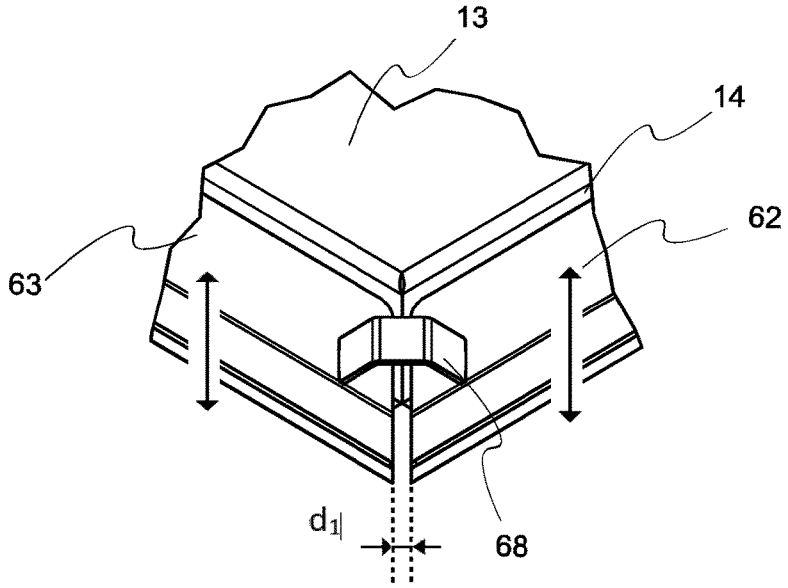
FIG. 2B shows a close-up view of the table top shown in FIG. 2A

Referring now to FIG. 2B, the side members 62, 63 are connected to each other by brackets 68. The bracket 68 is used to maintain the distance $d_1$, also referred to as the gap, between two adjoining elongated elements 62, 63 of the anti-squeezing mechanism and the bracket 68 furthermore enables that four elongated elements can be retained relative to one another. In one embodiment, four side members 62, 63, 64, 65 are positioned along the table top, the gap formed between two adjoining side members 62, 63, 64, 65 can be the same or it is also possible to vary the distance d1 and hereby achieving different gaps at the corners of the lifting table.

Referring now to FIG. 2A and FIG. 2B, the two side members 62, 63 are arranged along two adjoining sides of the table top 12, where the ends of the two side members 62, 63 are arranged with a distance d1 in between each other, such as 1-8 mm (shown in FIG. 2B).

Figure 3A:
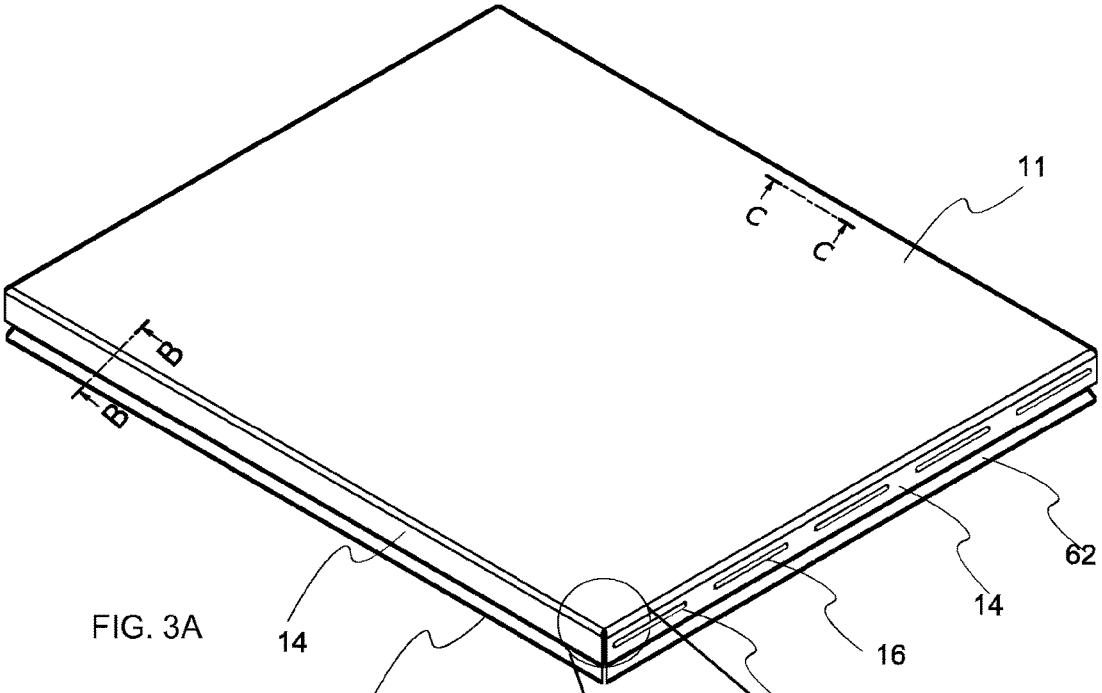
FIG. 3A shows a table top according to one preferred embodiment.
Figure 3B:
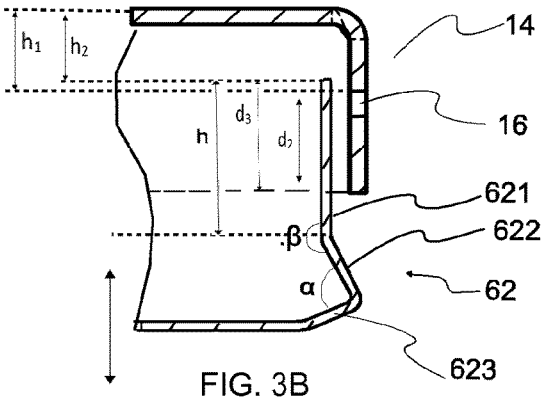
FIG. 3B shows a cross-sectional view (BB) of the table top shown in FIG. 3A.
Figure 3C:
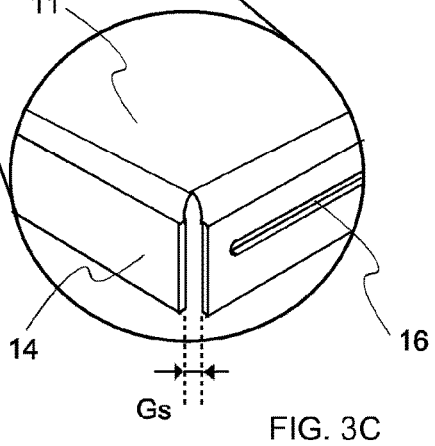
FIG. 3C shows a close-up view of the table top shown in FIG. 3A.
Figure 3D:
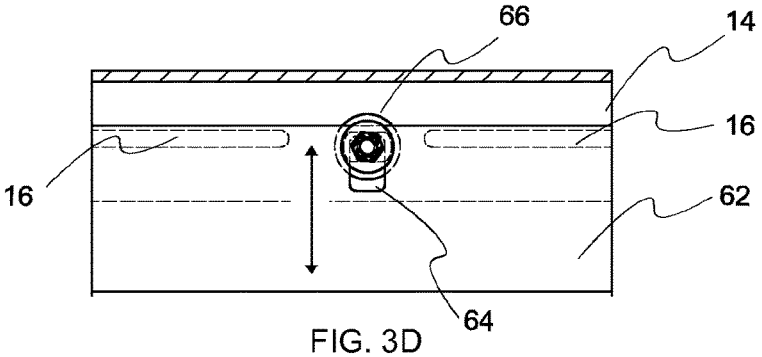
FIG. 3D shows a cross-sectional view (CC) of the table top shown in FIG. 3A.

Referring now to FIGS. 3A-3D, the table top 12 includes a number of side walls 14 arranged along the sides of the table top 12 and the side walls 14 extend perpendicularly to the upper face 11 of the table top 12. As shown in FIGS. 3A and 3C, it is possible to have a number of slots 16 in only one of the side walls 14. As shown in FIG. 3B, the slot 16 can be arranged at a second distance $d_2$ from the side end of the side wall 14. The height h of a wall part 621 of a side member 62 is larger than the second distance $d_2$ and as the second distance $d_2$ defined by the distance from the side end of the side wall 14 to the slot 16 is smaller than the height h of a wall part 621 of a side member 62, it is possible to cover the slots 16, hereby preventing the operator from blocking the slots e.g. by hanging different obstacles, such as hooks onto the table top 12. The angle β between the wall part 621 of a side member 62 and the first inclined part 622 is between 190-265 degrees. It should be appreciated that the gap Gs shown in FIG. 3C is only optional, as the invention could also work on a lifting table having a table top 12 without any corners being provided with a slit or aperture.

The height h of the wall part 621 of the side members 62 is provided for covering the slots 16 of the side walls 14 and each side members 62 can furthermore be provided with a inclined part 623 extending towards the center of the table top 12, preferably at an angle of 30-70 degree relative to the side wall 14, such as an angle of 30-50, 50-80 or 40-60 degrees. By using a curved, C-shaped or V-shaped geometry on the end of the side member 62, it is also possible to prolong the time and enhance the tacky effect of a cleaning foam, which unlike ordinary cleaning fluids allows the cleaning foam to work on the surfaces of the table top. This means that foam cleaning can be effectively used for cleaning both the anti-squeezing mechanism and the side walls of the table top with a minimal effort. It should be noted that above description of the side member 62 with reference number 62 also applies to the other side members 63, 64, 65.

In one embodiment, the side member 62 is provided with a curved end, such a v-shaped end (shown in FIG. 3B) or C-shaped end (not shown). The v-shaped end includes a first inclined part 622 extending in a first direction and a second inclined part 623 in a second direction. The second inclined part 623 can be arranged at an angle $\alpha$ of 45-90 degrees relative to the first inclined part 622.

Figure 4A:
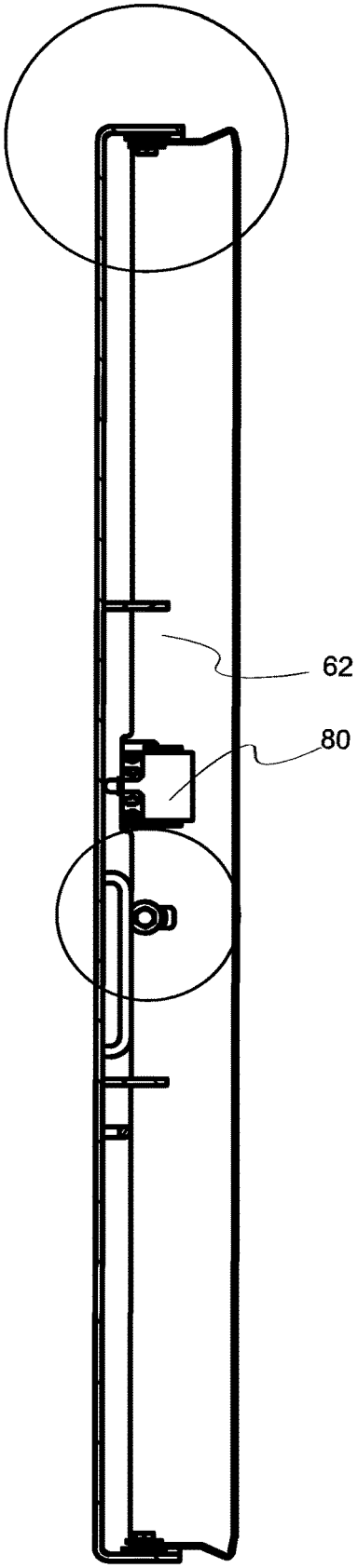
FIG. 4A shows a cross-sectional view of the table top shown in FIG. 3A.
Figure 4B:
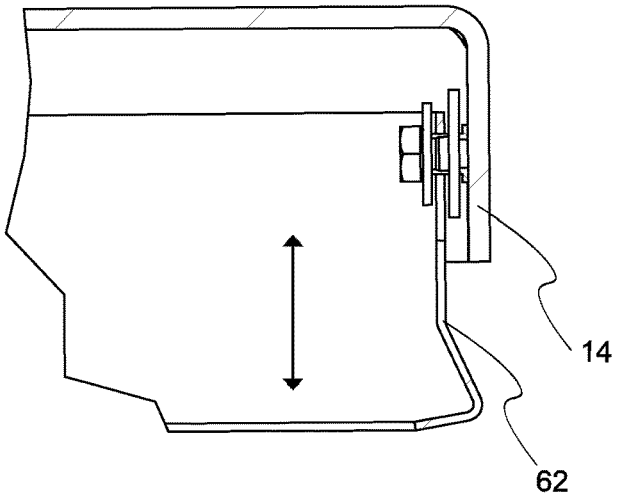
FIG. 4B shows one close-up view of the table top shown in FIG. 4A.
Figure 4C:
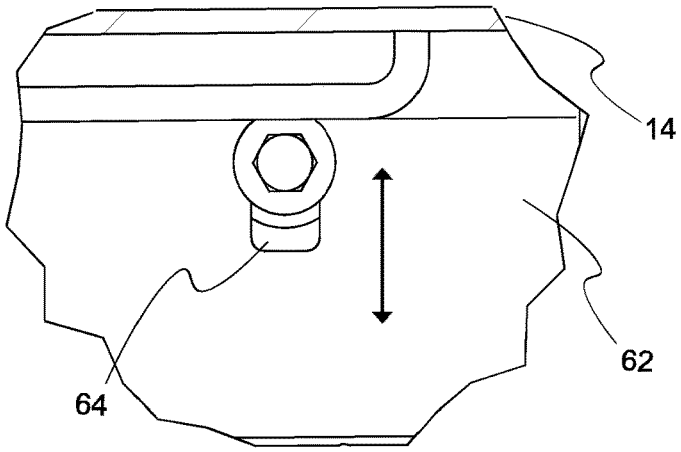
FIG. 4C shows one close-up view of the table top shown in FIG. 4A.

Referring now to FIGS. 4A-4C, each side member 62, 63, 64, 65 can be provided with a number of apertures 64 for allowing the side members 62, 63, 64, 65 to be moved relative to the table top 12. Reference is made to FIG. 4B, which shows that the curved end referred to in FIG. 3B could include a blunt end part 624

Referring now to FIGS. 6A-6D, the lifting mechanism 20 includes two sets of elongated elements 22. Each set of legs includes two elongated elements 22,24. The two elongated elements 22,24 in each set are connected together. The connection can be any type of connection that enables the two elongated elements to move relative to one another about the connection.

As illustrated in FIGS. 1, 5A-5B and 6A-6D the connection is generally positioned at or near the mid-longitudinal region of the elongated elements; however, this is not required.

Figure 6A:
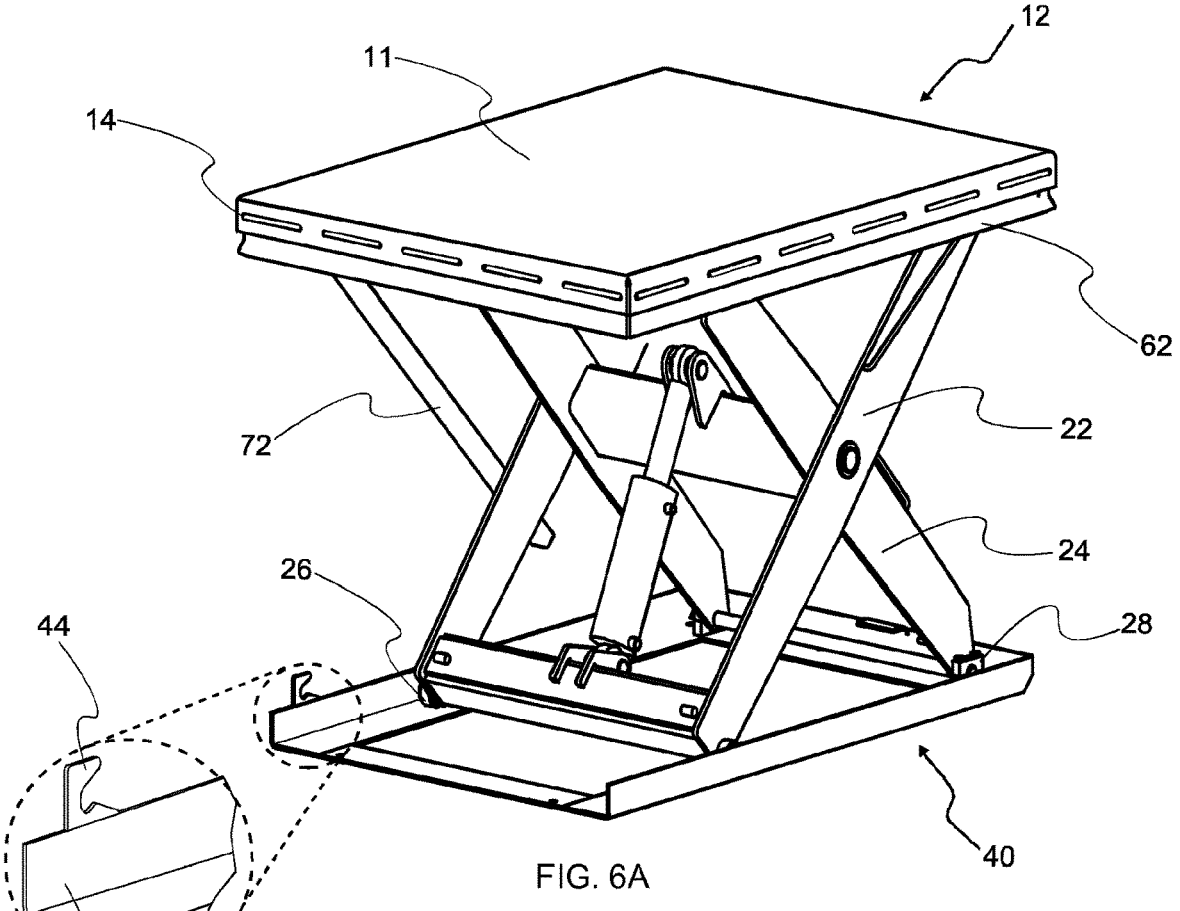
FIGS. 6A-6*d* illustrates a method of adjusting the inclination of the table top of said lifting table in a step prior to cleaning and disinfected said lifting table.
Figure 6B:
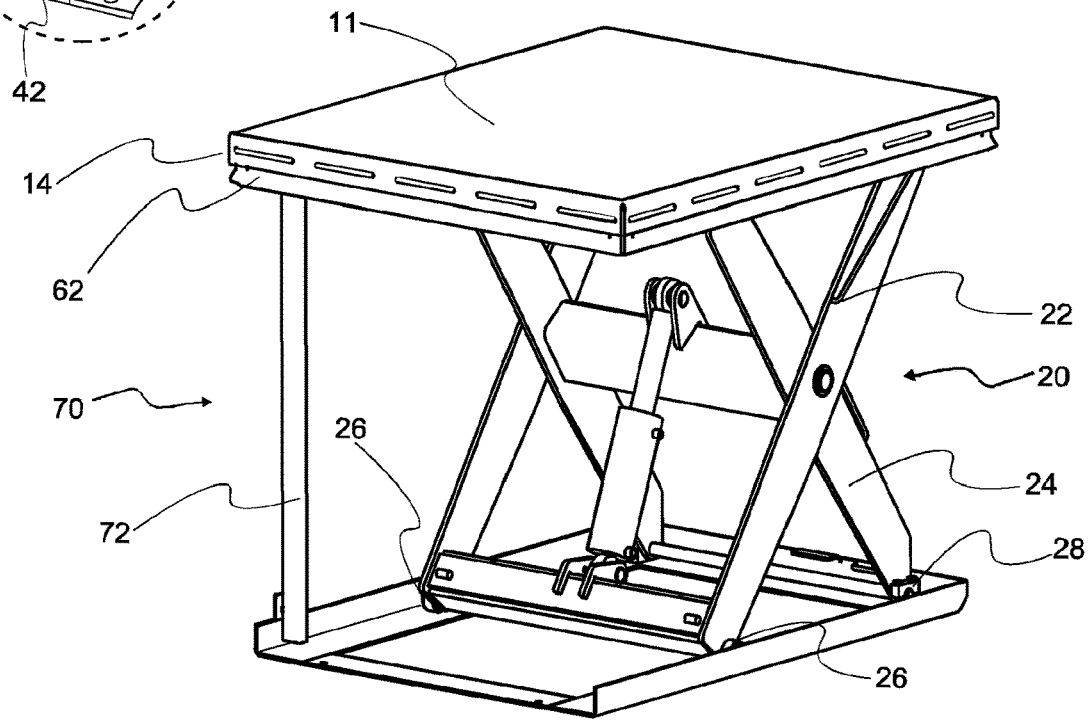
Figure 6C:
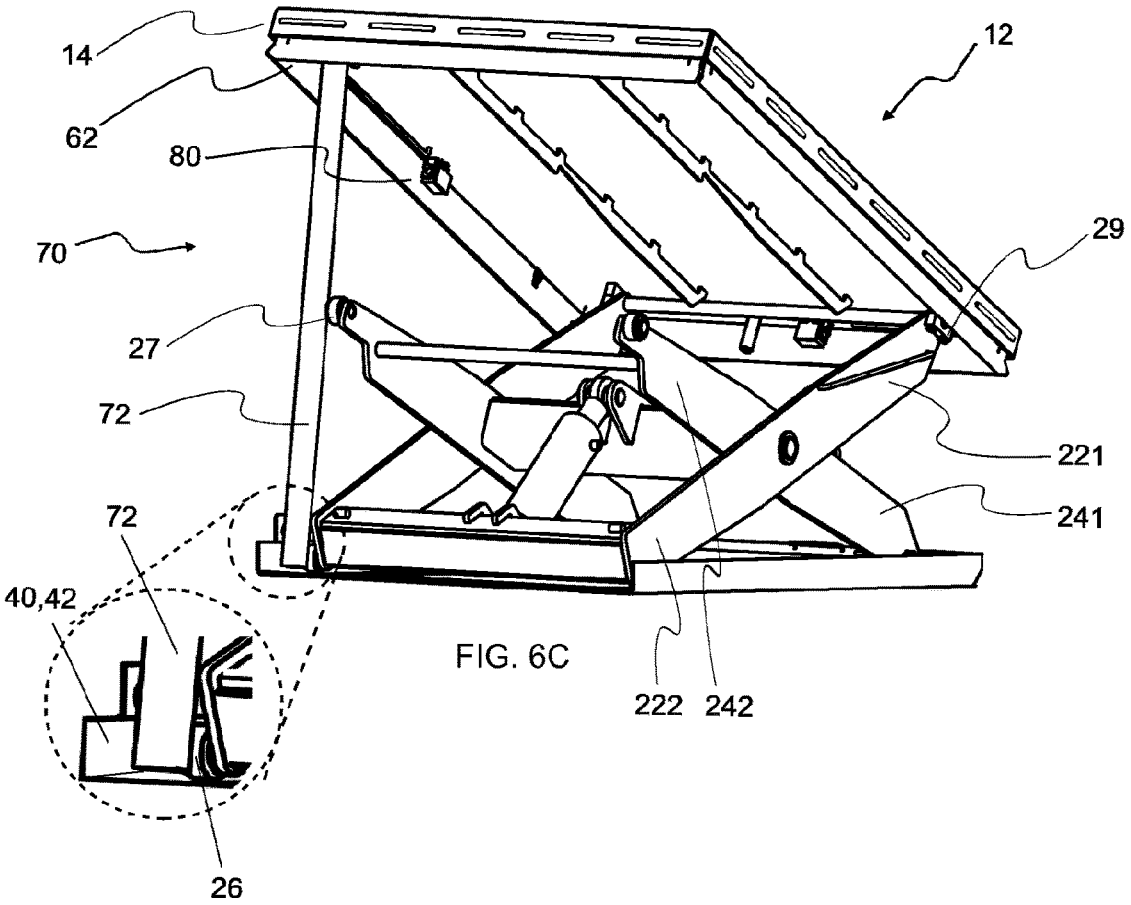
Figure 6D:
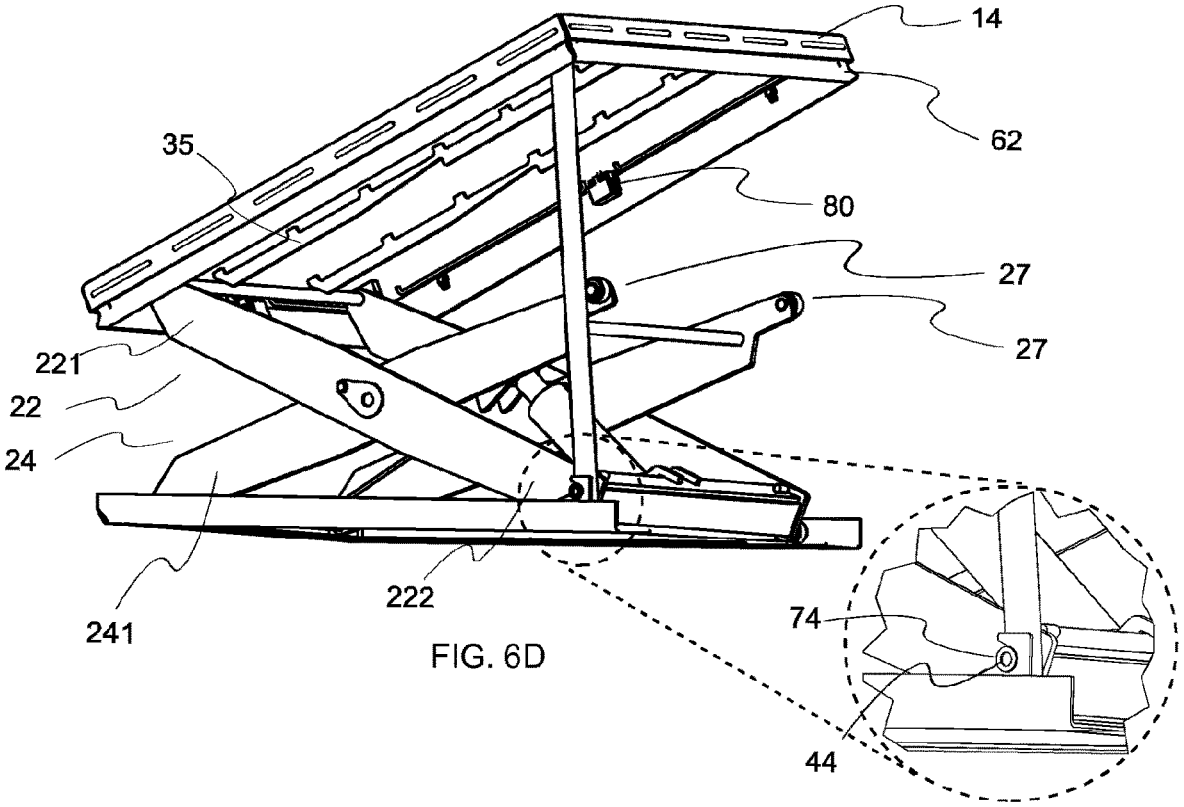

Referring now to FIGS. 6C-6D, a roller or a wheel 27,28 is connected to the front end 222, 242 of the elongated elements 22,24. The wheels or rollers, when used, enable the front end 222,242 of elongated elements 22,24 move along the base of the lifting table 10, hereby allowing the lifting mechanism 20 to move between an elevated or raised position and non-elevated position. As can be appreciated, as the lifting mechanism 20 moves from a non-elevated position to a raised position, the front end 222,242 of legs move toward the back end of the elongated elements legs 22, 24. Likewise, as the lifting mechanism 20 moves from an elevated or raised position to a non-elevated or lower position, the front end 222, 242 of the elongated elements 22,24 move away from the back end 221,241 of the elongated elements 22,24. The wheels or roller facilitate in such movement of the elongated elements 22,24 over the base 40. The table top could also include a number reinforcement bars 35 arranged on the lower face of the table top 12. The base 40 includes a number of side walls 42 for guiding the lifting mechanism 20 during movement of the table top 12 relative to the base 40.

Referring now to FIGS. 6A-6D, the lifting table 10 further includes a leg element 72 being pivotably connected to the table top 12 at a first leg element end, preferably to a lower face 13, wherein a fixation element 44 is provided on the base 40 for engaging a connecting element 74 positioned on the leg element 72, preferably on the opposite end of the first leg element end.

As mentioned with reference to the previous figures, the lifting mechanism 20 is connected to the table top 12 through a number of fixating mounting brackets 28,29 for allowing the elongated elements 22,24 to rotate relative to the table top 12 at a first end and each elongated element 22,24 furthermore includes a roller 26,27 being positioned at the opposite end of the first end. The first end would also be referred to as the back end, whereas the front end of the elongated element 22,24 would be referred to as the second end of the elongated element 22,24.

Operation of the lifting table 10 can be performed by an operator either directly or remotely by using a wireless communication unit connected to the controller of the lifting table. According to a second aspect to the present invention, it is possible to activate a safety mode when at least one side member 62, 63, 64, 65 is moved from a first position, where all side members 62, 63, 64, 65 are disengaged from the switch element 80 to a second position, where the side member 62, 63, 64, 65 engages the switch element 80, hereby preventing further displacement of the table top 12 relative to the base 40.

In the event that all four side members 62, 63, 64, 65 are connected to each other by using four brackets 68, there will be no individual displacement of the side member 62, 63, 64, 65 relative to the table top 12.

The cleaning of the table may include a physical cleaning step and optional a chemical cleaning step. The physical cleaning step may be performed by an operator, who spools the lifting table with a water jet, preferably a low-pressure water jet for preventing the contamination or dirt attached to the lifting table from being spread further. The operator would spool the lifting table at an angle between 5-90 degrees relative to the surface to be cleaned. In a subsequent chemical cleaning step, the operator would apply a chemical cleaning product onto the surface of said lifting table. The cleaning and disinfecting process can be performed in combination with each other, as it is also possible only to perform the cleaning or disinfecting step.

When it is time to clean the lower face 13 of the lifting table, the table top of the lifting table can be adjusted to an inclined angle relative to the ground floor. By adjusting the table top to an inclined portion, the operator may perform a visual inspection prior to the actual of performing the cleaning and/or disinfecting process. The inclined position of the table would also allow the operator to have a better work position, when he has to clean the underside of the lifting table. The cleaning and/or disinfecting process of the lifting table 10 can involve the following steps:

- operating the lifting table 10 in a first operational mode, wherein the first operational mode includes the steps of:
  - i. raising the table top 12 to a first elevated position relative to the base 40 by operating the actuator 30 and the lifting mechanism 20, wherein the first elevated position can be the maximum extension height for the lifting table 10 (shown in FIG. 6A);
  - ii. retracting the leg element 72 from a first retracted position to a first extended position (shown in FIG. 6A);
  - iii. fixating the leg element 72 in a first fixating position (shown in FIG. 6B, where the leg element 72 engages the fixation element 44 on the base 40, see FIG. 6*d*);
- operating the lifting table 10 in a second operational mode, wherein the table top 12 is lowered to a second height position by operating the actuator 30 and the lifting mechanism 20, wherein the leg elements causes the table top 12 to be moved into a first inclined position as the platform is moved from a first elevated position to a second elevated position, wherein the table top 12 will be positioned at an angle of 30-60 degrees relative to the base 40 in the second elevated position.

As would be evidently from FIG. 6D, the leg element 72 is retained relative to the base 40 by the fixation element 44 positioned on the base 40 and the roller arranged on the front end of the elongated element 22,24.

In a subsequent step, the method can include raising the table top 12 into a substantially vertical position by operating the actuator according to a third operational mode, wherein the actuator exerts a force onto the lifting mechanism 20 being connected to the lower face of the table top 12.

The cleaning product used could be a cleaning foam, where a dosing unit having a nozzle is used for applying the cleaning foam on the contaminated surface. The chemical product can be mixed with water from a pressure cleaner. The foam must be allowed some time (typically 10-30 min) to fight dirt etc. on a lifting table according to the present invention.

Depending on the type of contamination, the waiting time varies. For example, if there is a fight against dried dairy product dirt, the waiting time will often be longer for an effective result. In case of highly resistant contamination, it may be necessary to help with scouring fungus or the like.

The structural parts of the lifting table would in one embodiment have a surface, which have be treated using an electropolishing method. By using an electropolishing process on the surface of the structural parts of the lifting table, it is possible to achieve a surface finish with very low surface roughness values, hereby reducing the tendency for dirt or dust from adhering to the surface of the table top. The most common electrolytes for the electropolishing of stainless steel are varying concentrations of phosphoric and sulphuric acid, and occasionally additives such as chromic acid.

During the step of cleaning the table, the lifting table could be positioned in at least two positions during the cleaning process. The first position would be a top position, where the leg element is retracted from a retracted position or a separate arm is inserted in between the lifting mechanism and the table top.

The second positon would be moving the table top down so that the table top is arranged in an inclined position, whereby exposing the lower face (underside) of the table to make cleaning under the lifting table possible. Moving the table top so that cleaning can be performed in all the area.

The invention claimed is:

1. A lifting table comprising:

a table top comprising:

a polygonal contour;

an upper face; and a lower face;

a lifting mechanism connected to the table top and comprising an actuator for raising and lowering the table top;

a base being configured for supporting the lifting mechanism;

a first side member and a second side member positioned along two adjoining sides of the table top; and a switch element positioned below the upper face, wherein the first side member and the second side member are connected to the table top below the upper face allowing the first side member and the second side member to be moved between a first position, wherein the first side member and the second side member are disengaged from the switch element and a second position where the first side member and the second side member activate the switch element, hereby preventing displacement of the table top relative to the base;

wherein ends of first side member and the second side member are arranged with a distance $d^1$ in between each other; and wherein the lifting table further comprises a leg element pivotably connected to the table top at a leg element end, wherein a fixation element is provided on the base for engaging a connecting element positioned on the leg element.

2. The lifting table according to claim 1, further comprising one or more additional side members, wherein a number of the first side member, the second side member, and the one or more additional side members corresponds to a number of sides of the table top.

3. The lifting table according to claim 2, wherein the first side member, the second side member, and the one or more additional side members are connected to each other by a number of brackets.

4. The lifting table according to claim 1, wherein the first side member is provided with a v-shaped, wherein the v-shaped end comprises:

a first inclined part extending in a first direction; and a second inclined part in a second direction, wherein the second inclined part is arranged at an angle $\alpha$ between 45-90 degrees relative to the first inclined part.

5. The lifting table according to claim 1, wherein the lifting mechanism is connected to the table top through a number of fixating mounting brackets for allowing elongated elements to rotate relative to the table top at a first end, wherein each of the elongated elements comprises a roller positioned at an opposite end of the first end.

6. The lifting table according to claim 1, wherein the lifting mechanism comprises elongated elements connected to the table top and the elongated elements are arranged to form a scissor mechanism, wherein the elongated elements are made from a metallic element selected from the group consisting of stainless steel and a galvanized metal.

7. The lifting table according to claim 1, wherein the lifting table further comprises a controller connected to the actuator and the switch element, wherein the switch element is configured for deactivating the actuator.

8. The lifting table according to claim 1, wherein the actuator is selected from the group consisting of: a hydraulic actuator connected to a power source for supplying hydraulic fluid to the actuator, a pneumatic driven spindle connected to a power source for supplying hydraulic fluid to the actuator, and a motor driven spindle connected to a power source for supplying hydraulic fluid to the actuator.

9. The lifting table according to claim 1, wherein the polygonal contour is a rectangle so that the table top has four sides and the table top comprises a third side member and a fourth side member.

10. The lifting table according to claim 1, wherein the first side member is provided with a C-shaped end.

11. The lifting table according to claim 1, wherein the lifting table further comprises a leg element pivotably connected to the base at a leg element end, and wherein the leg element engages the table top.

12. A lifting table comprising:

a table top comprising:

a polygonal contour;

an upper face; and a lower face;

a lifting mechanism connected to the table top and comprising an actuator for raising and lowering the table top;

a base being configured for supporting the lifting mechanism;

a first side member and a second side member positioned along two adjoining sides of the table top; and a switch element positioned below the upper face, wherein the first side member and the second side member are connected to the table top below the upper face allowing the first side member and the second side member to be moved between a first position, wherein the first side member and the second side member are disengaged from the switch element and a second position where the first side member and the second side member activate the switch element, hereby preventing displacement of the table top relative to the base;

wherein ends of first side member and the second side member are arranged with a distance $d^1$ in between each other; and wherein the table top comprises a first side wall and a second side wall arranged along the two adjoining sides of the table top, wherein the first side wall and the second side wall extend perpendicularly to the upper face of the table top, wherein the first side wall has slots arranged at a first distance from a side end of the first side wall.

13. The lifting table according to claim 12, wherein each of the first side member and the second member is provided with one or more apertures for allowing the first side member and the second side member side members to be moved relative to the table top.

14. The lifting table according to claim 13, wherein a height of the first side member is provided for covering the slots of the first side wall.

15. The lifting table according to claim 14, wherein the first side member is provided with a side member end extending towards a center of the table top at an angle of 30-70 degrees.

16. The lifting table according to claim 13, wherein the first side member is provided with a side member end extending towards a center of the table top at an angle of 30-70 degrees.

17. An adjustment method for a lifting table prior to a cleaning and/or disinfecting process of the lifting table, wherein the lifting table comprises:

a table top comprising:

a polygonal contour;

an upper face; and a lower face;

a lifting mechanism connected to the table top and comprising an actuator for raising and lowering the table top;

a base being configured for supporting the lifting mechanism;

a first side member and a second side member positioned along two adjoining sides of the table top; and a switch element positioned below the upper face, wherein the first side member and the second side member are connected to the table top below the upper face allowing the first side member and the second side member to be moved between a first position, wherein the first side member and the second side member are disengaged from the switch element and a second position where the first side member and the second side member activate the switch element, hereby preventing displacement of the table top relative to the base;

a leg element pivotably connected to the table top or the base at a leg element end;

wherein ends of first side member and the second side member are arranged with a distance $d_1$ in between each other; and wherein the method comprises:

operating the lifting table in a first operational mode, wherein the first operational mode comprises:

raising the table top to a first elevated position relative to the base by operating the actuator and the lifting mechanism, wherein the first elevated position can be a maximum extension height for the lifting table;

retracting the leg element from a retracted position to an extended position; and fixating the leg element in a fixating position; and operating the lifting table in a second operational mode, wherein the table top is lowered to a second elevated position by operating the actuator and the lifting mechanism, wherein the leg element causes the table top to be moved into an inclined position as the table top is moved from the first elevated position to the second elevated position, wherein the table top will be positioned at an angle of 30-60 degrees relative to the base in the second elevated position.

18. The adjustment method for a lifting table according to claim 17, wherein the method further comprises:

raising the table top into a substantially vertical position by operating the actuator according to a third operational mode, wherein the actuator exerts a force onto the lifting mechanism being connected to the upper face of the table top.

19. The adjustment method for a lifting table according to claim 17, wherein the leg element is pivotably connected to the table top at the leg element end, and wherein a fixation element is provided on the base for engaging a connecting element positioned on the leg element.

20. The adjustment method for a lifting table according to claim 17, wherein the leg element is pivotably connected to the base at the leg element end, and wherein the leg element engages the table top.

* * * * *